US009364700B2

(12) United States Patent
Yan

(10) Patent No.: US 9,364,700 B2
(45) Date of Patent: Jun. 14, 2016

(54) WAIST TWISTING STATION

(71) Applicant: Hui Yan, Marietta, GA (US)

(72) Inventor: Hui Yan, Marietta, GA (US)

( * ) Notice: Subject to any disclaimer, the term of this patent is extended or adjusted under 35 U.S.C. 154(b) by 0 days.

(21) Appl. No.: 14/483,173

(22) Filed: Sep. 11, 2014

(65) Prior Publication Data

US 2015/0111707 A1 Apr. 23, 2015

Related U.S. Application Data

(60) Provisional application No. 61/876,772, filed on Sep. 12, 2013.

(51) Int. Cl.

| | |
|---|---|
| ***A63B 26/00*** | (2006.01) |
| ***A63B 21/015*** | (2006.01) |
| ***A63B 21/04*** | (2006.01) |
| ***A63B 21/00*** | (2006.01) |
| ***A63B 19/00*** | (2006.01) |
| ***A63B 22/18*** | (2006.01) |
| ***A63B 23/02*** | (2006.01) |

(Continued)

(52) U.S. Cl.

CPC ..... *A63B 21/00127* (2013.01); *A63B 19/00* (2013.01); *A63B 21/022* (2015.10); *A63B 21/4009* (2015.10); *A63B 21/4025* (2015.10); *A63B 21/4031* (2015.10); *A63B 21/4035* (2015.10); *A63B 21/4043* (2015.10); *A63B 21/4049* (2015.10); *A63B 22/18* (2013.01); *A63B 23/02* (2013.01); *A63B 23/12* (2013.01); *A61H 2015/0064* (2013.01); *A61H 2201/0192* (2013.01); *A61H 2201/1261* (2013.01); *A61H 2201/1628* (2013.01); *A61H 2201/1635* (2013.01); *A61H 2203/0406* (2013.01); *A61H 2205/08* (2013.01); *A63B 2213/00* (2013.01); *A63B 2225/093* (2013.01)

(58) Field of Classification Search

CPC .. A63B 19/00; A63B 19/04; A63B 21/00127; A63B 21/0608; A63B 21/02; A63B 21/023; A63B 21/025; A63B 21/04; A63B 21/0407; A63B 21/4021; A63B 21/045; A63B 21/1419; A63B 21/1492; A63B 2069/0008; A63B 21/4025; A63B 21/18; A63B 23/02; A63B 2213/00; A63B 2023/003; A63B 21/4049; A63B 21/4023; A63B 21/4009; A63B 19/02; A63B 21/00; A63B 21/4001; A61H 1/00; A61H 1/001; A61H 7/00; A61H 7/007; A61H 11/00

USPC ..... 446/236

See application file for complete search history.

(56) References Cited

U.S. PATENT DOCUMENTS 2,958,144 A * 11/1960 Stranges ..... A63H 13/12 40/411
3,861,382 A * 1/1975 Simjian ..... A61H 15/0078 482/132
3,915,158 A * 10/1975 Simjian ..... A61H 11/00 482/132

(Continued)

*Primary Examiner* — Oren Ginsberg
*Assistant Examiner* — Nyca T Nguyen
(74) *Attorney, Agent, or Firm* — Wang Law Firm, Inc.

(57) ABSTRACT

A waist twisting station includes a base, a rotating unit for waist twisting, and at least one spring to generate resistance force. The rotating unit has a hoop linked with a spring, which can be pushed away by user's body movement. The inside layer of the hoop has a row of massage balls so that the body movement can exercise the waist and lags as well as receive body massage at the same time to accelerate calorie burning. In addition to the waist twisting hoop, a handle bar with or without spring connected to the base can give user a unique whole body exercise experience.

11 Claims, 4 Drawing Sheets

(51) Int. Cl.
*A63B 23/12* (2006.01)
*A61H 15/00* (2006.01)

(56) References Cited

U.S. PATENT DOCUMENTS 3,945,637 A * 3/1976 Simjian ..... A61H 11/02 482/62
3,960,144 A * 6/1976 Simjian ..... A63B 22/0605 601/132
D336,122 S * 6/1993 Vasseur ..... D21/686
6,533,635 B1 * 3/2003 Chern ..... A63B 19/02 446/236
6,758,792 B1 * 7/2004 Chang ..... A61H 1/0218 482/118
9,114,274 B2 * 8/2015 Kwon ..... A61H 1/0237
2003/0158021 A1 * 8/2003 Prichard ..... A63B 21/04 482/123
2008/0269029 A1 * 10/2008 Heck ..... A61H 11/02 482/129

* cited by examiner

WAIST TWISTING STATION

RELATED APPLICATIONS

This application claims priority to U.S. Provisional No. 61/876,772, entitled "Waist Twisting Station," filed on Sep. 12, 2013.

BACKGROUND OF THE INVENTION

The invention relates to fitness equipment, particularly waist-training machine for a user to twist his or her waist in the same way as a hula-hoop but with much more resistance force, at the same time massaging the waist.

Many kinds of fitting equipment are widely used nowadays, for twisting the waist and buttocks. Simjian (U.S. Pat. No. 3,945,637) and Chang (U.S. Pat. No. 6,918,856) tried to invent the waist massage and waist exercise machines. Traditional hula-hoops have been used for twisting the waist and the buttocks for acquiring body training owing to its soft smooth movement, very prevalent among consumers. However, the traditional hula-hoops have some disadvantages. 1. A person should have certain experience or technique, or the person will be unable to maneuver it smoothly on the waist. 2. The traditional hula-hoop doesn't have enough resistant force on user's waist; therefore take longer time to burn calories. 3. In starting to move around the traditional hula-hoop on the waist, a person is prone to harm the waist, especially for the old. 4. The traditional hula-hoop can't efficiently massage the waist or buttocks to help burning stomach and waist fat.

In current invention, a waist-twisting station includes a base, a rotating unit (waist twisting hoop) connected to at least one spring leg, and a handle bar with or without spring(s). For the one spring leg example, the spring axis 16 and the waist twisting hoop axis are overlapped. The spring can be coil spring or a piece of spring material column. The base has a foot board on it, the vertical handle bar is connected to the front part of the base, and the waist twisting hoop is connected to the base by a vertical spring and connection bar(s). The waist twisting hoop has a row of rotatable balls or rollers on the inner lay. The height of the waist twisting hoop and handle bar can be adjusted to higher and lower position to fit user's waist and hands.

The waist twisting hoop is pushed by the user in a circular around the vertical spring, provided with massage rollers (balls) in its inner surface so that a user entering the waist twist hoop may do circular (or twisting) action and receive massage action synchronously, obtaining the effect of waist twisting exercise and slimming at the same time. The massage will help burn the fat.

SUMMARY OF THE INVENTION

This invention relates to a waist twisting station with spring to offer resistant force. The rotatable balls or rollers on the rotating unit (waist twisting hoop) offer smooth movement of user's body along the hoop and give massage to user at the same time. The user twists the waist against the hoop and receives the spring's force and also receives massage action from the balls or rollers at the same time. This exercise can slim the body and build waist and abdomen mussel. Also the waist twisting station can be used as arm exercise equipment by bending the spring connected to the handle bar.

BRIEF DESCRIPTION OF THE DRAWING

This invention will be better understood by referring to the accompanying drawings, wherein.

DETAILED DESCRIPTION OF THE INVENTION

Figure 1:
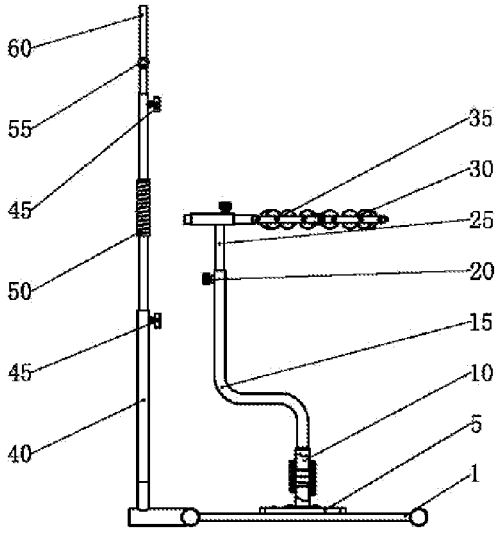
FIG. 1 is the side view of the waist twisting station.
Figure 2:
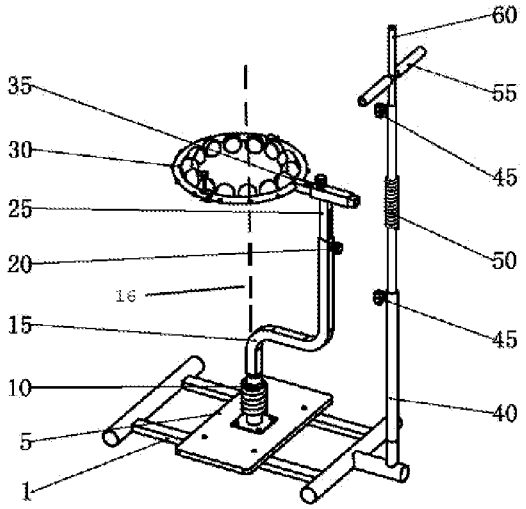
FIG. 2 is a perspective view of a waist-twisting station.
Figure 3:
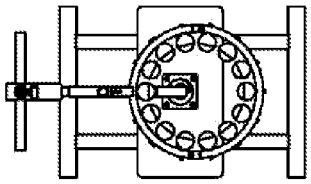
FIG. 3 is a top view of the waist twisting station.
Figure 4:
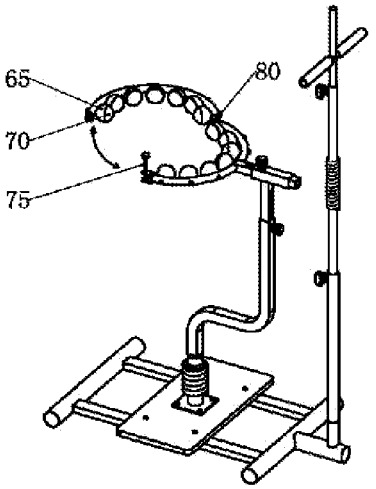
FIG. 4 is a perspective view of a waist-twisting station with the hoop open in the present invention.

A preferred embodiment of a waist twisting station in the present invention, as shown in FIGS. 1-4, includes a base 1, a waist twisting hoop 30, a foot board 5, a main spring 10, a spring legs 15 and a spring handle bar 55 with handle bar spring 50. The main spring 10 has an axis passing through the center of the main spring 10. The waist twisting hoop also has an axis passing through the center of the waist twisting hoop. The axis of the main spring 10 and the axis of the waist twisting hoop 30 are substantially overlapped to make the resistance force the same when push against the waist twisting hoop 30 in any direction. The main spring can be coil spring or a piece of spring steel column or other spring material column.

The leg 15 has an adjustable sleeve with adjust knob 20 to adjust the height of the waist twisting hoop 30. Also the waist twisting hoop 30 can be moved in horizontal direction via T-link 25 and the adjust knob 35. The handle bar 55 also has an adjustable sleeve with adjust knob 53 to adjust the handle bar height as well as the resistance force. The vertical bar 40 and 48 are linked by the adjust knob 45.

Figure 5:
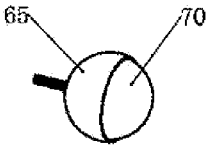
FIG. 5 is a side view of a free-rotation massage ball on the hoop.
Figure 6:
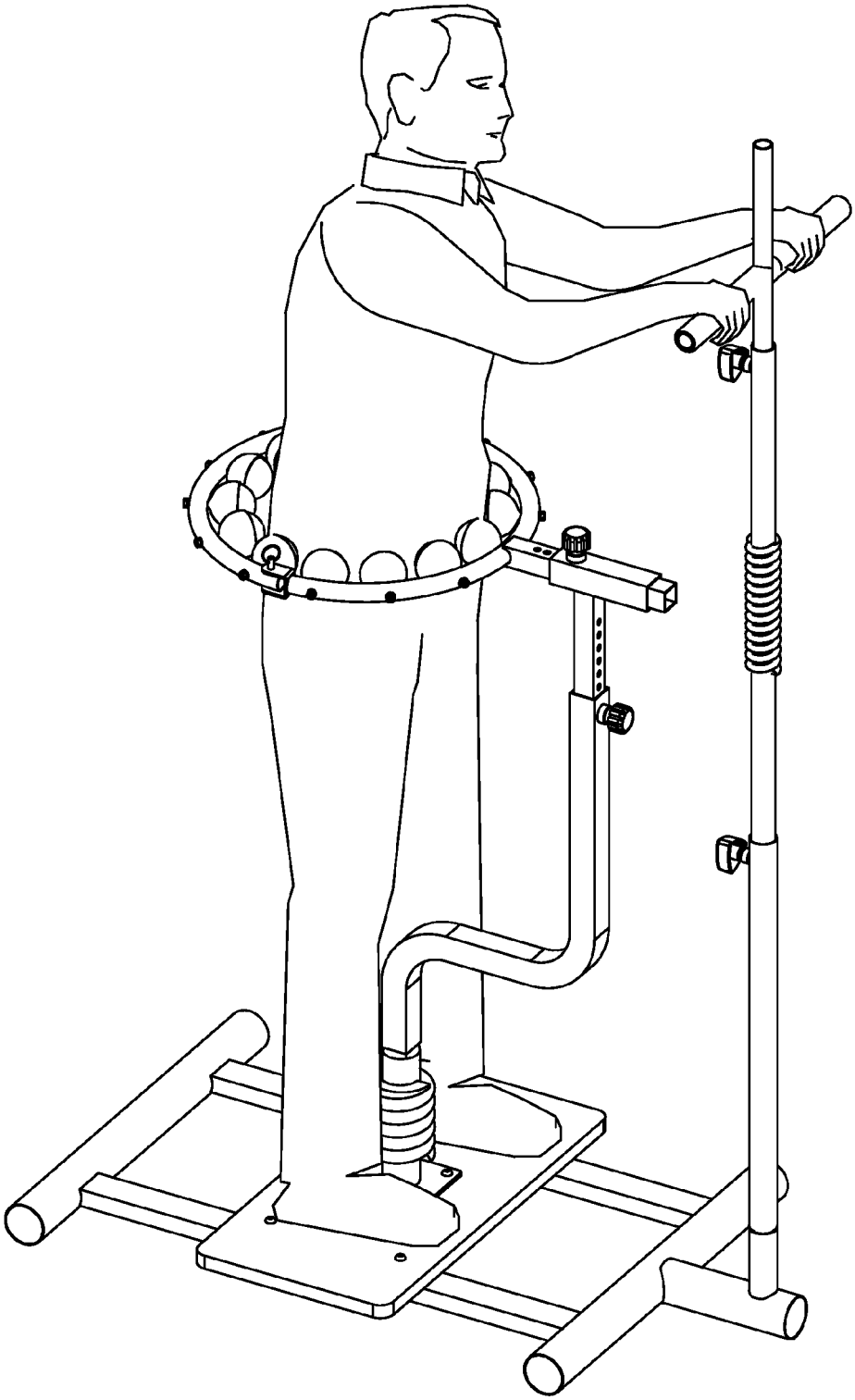
FIG. 6 is a view of the waist twisting station in a using condition by a person with neutral standing position in the present invention.
Figure 7:
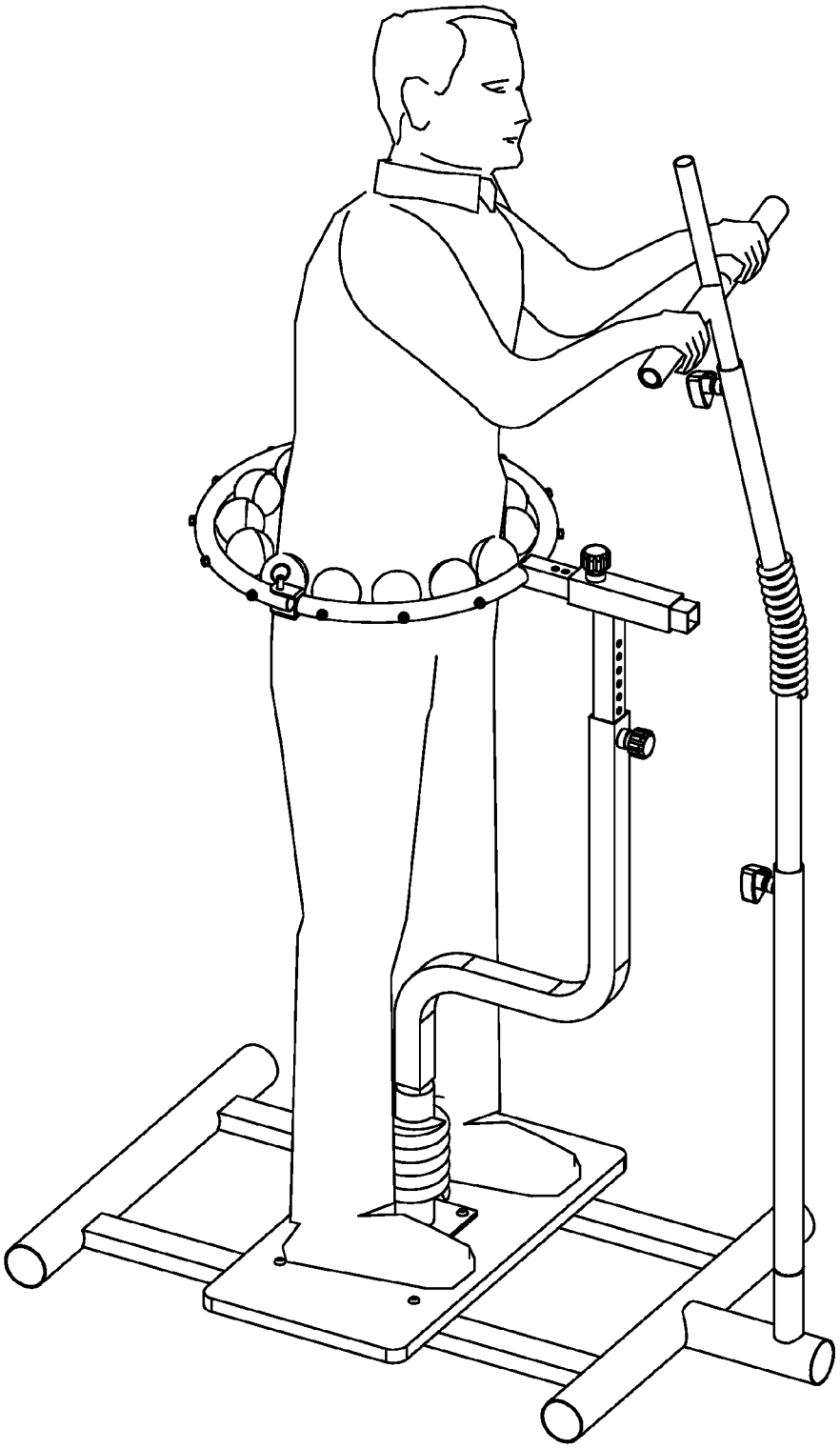
FIG. 7 is a view of the waist twisting station in a using condition by a person pulling the handle bar backward in the present invention.
Figure 8:
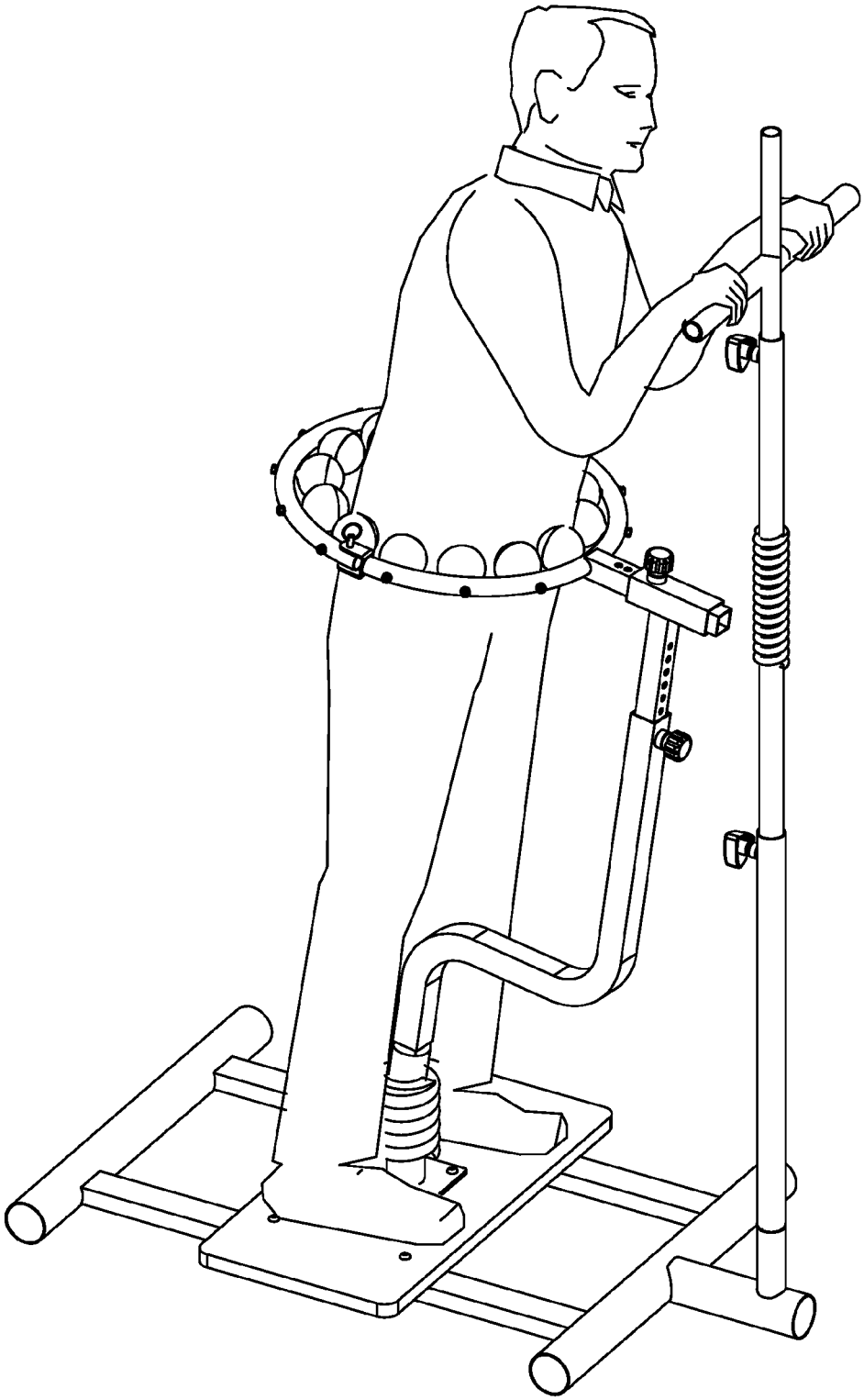
FIG. 8 is a view of the waist twisting station in a using condition by a person with forward position leaning forward against ring in the present invention.

The waist twisting hoop 30 has multiple holes to hold a row of rotating balls 65/70. Also, the waist twist hoop 30 with hinge link 80 can be opened and closed using a pin 75 as showed in FIG. 4. Massage ball 70 was fixed inside the ball holder 65 and can free rotate inside the ball holder 65 as showed in FIG. 5.

The handle bars 55 and 60 have an adjustable sleeve with adjust knob 53, vertical bars 51 and 48 are connected by spring 50.

The user stands on the foot board and close the waist twisting hoop 30 to lock his/her waist in it, put hands on the handle bar horizontal support arm 55, then rotate his/her waist to move the waist twisting hoop 30 from side to side or rotate in circular. When the waist twisting hoop 30 is pushed aside, the force from the main spring 10 will push the waist twisting hoop 30 against user's waist. The massage ball 70 can rotate while the waist moves around the waist twisting hoop 30 to give waist massage and generate less friction on waist during the waist movement.

The waist twisting hoop comes with different diameter to fit user's waist. The main spring 10 and handle bar spring 50 come with different strength to fit different user's need.

Handle bar 55 and 60 can also be used to exercise user's arms by pushing, pulling, side bending, and rotating around the axis. This waist twisting station is good for waist, hip, leg, and arm exercise.

This invention can have at least following embodiments:

1. The waist twisting hoop can have one or more than one spring(s) attached on it;
2. The waist twisting hoop can have a hoop only or can have rotating balls or other rollers on the hoop inner circle to allow smooth body movement and generate massage function on user's body;
3. This waist twist station can have handle bar with spring, handle bar without spring, or even without handle bar;
4. This waist twist station can have spring handle bar along without waist twisting hoop, this is therefore the arm exercise station.

The invention I claim is:

1. A waist twisting station comprising:

a base;

a main spring connected to the base;

a spring leg connected to the main spring;

a waist twisting hoop connected to the spring leg, the waist twisting hoop being equipped with balls;

a vertical bar attached to the base; and a handle bar attached to the vertical bar through a second spring, wherein the second spring enables the handle bar to move laterally and the main spring enables the waist twisting hoop also to move laterally.

2. The waist twist station as claimed in claim 1, wherein said main spring is vertically assembled to a foot board connected to the base.

3. The waist twist station as claimed in claim 1, wherein said waist twisting hoop further comprising a hinge for opening the waist twisting hoop.

4. The waist twist station as claimed in claim 1, wherein the waist twisting hoop being substantially concentric to the main spring.

5. The waist twist station of claim 1, wherein the handle bar is configured to be adjusted vertically by adjusting a length of the vertical bar.

6. A waist twist station comprising:

a base;

a main spring connected to the base;

a spring leg connected to the main spring, the spring leg having a top end, a waist twist hoop connected to the top end of the spring leg, a vertical bar connected to the base, the vertical bar having a second spring, and a handle bar connected to the vertical bar;

wherein the main spring enables the waist twist hoop to move laterally, and wherein the handle bar moves laterally.

7. The waist twist station of claim 6, wherein the handle bar is configured to be adjusted vertically by adjusting a length of the vertical bar.

8. The waist twist station of claim 6, wherein the waist twist hoop further comprising a hinge that enables the waist twist hoop to open.

9. The waist twist station of claim 6, wherein the waist twist hoop further comprising a plurality of rotating elements.

10. The waist twist station of claim 6, wherein the main spring has a first axis and the waist twist hoop has a second axis, the first axis and the second axis overlaps each other.

11. The waist twist station of claim 6, wherein the waist twist hoop is configured to be adjusted vertically by adjusting a length of the spring leg.

* * * * *